US005517200A

United States Patent [19]

McAdam et al.

[11] Patent Number: 5,517,200

[45] Date of Patent: May 14, 1996

[54] METHOD FOR DETECTING AND ASSESSING SEVERITY OF COORDINATED FAILURES IN PHASED ARRAY ANTENNAS

[75] Inventors: William W. McAdam, Huntsville, Ala.; Mark D. Holcomb, Ellicott City, Md.; Judith D. Specht, Stevensville, Md.; Joel A. Carlson, Linthicum, Md.

[73] Assignee: The United States of America as represented by the Secretary of the Air Force, Washington, D.C.

[21] Appl. No.: 265,363

[22] Filed: Jun. 24, 1994

[51] Int. Cl.[6] ..... H01Q 3/00

[52] U.S. Cl. ..... 342/360; 343/703

[58] Field of Search ..... 342/372, 360, 342/173, 174

[56] References Cited

U.S. PATENT DOCUMENTS

| | | | |
|---|---|---|---|
| 4,176,354 | 11/1979 | Hsiao et al. | 343/17.7 |
| 4,811,023 | 3/1989 | Gelernter et al. | 343/703 |
| 4,924,232 | 5/1990 | Hudson et al. | 342/174 |
| 4,926,186 | 5/1990 | Kelley et al. | 342/360 |
| 5,198,821 | 3/1993 | Skrzypczak | 342/360 |

*Primary Examiner*—Theodore M. Blum
*Attorney, Agent, or Firm*—William G. Auton

[57] ABSTRACT

A method is described for determining when maintenance is required for a phased antenna array in which a number of individual antenna modules may have failed. The method provides for the assigning of a value to each failed module, depending on where the module is located within the array, and also depending on whether the module is "coordinated" with one or more other failed modules. A threshold value for the aggregate of all the values of the failed modules is established and upon exceeding the threshold, maintenance of the array is indicated.

6 Claims, 1 Drawing Sheet

METHOD FOR DETECTING AND ASSESSING SEVERITY OF COORDINATED FAILURES IN PHASED ARRAY ANTENNAS

STATEMENT OF GOVERNMENT INTEREST

The invention described herein may be manufactured and used by or for the Government for governmental purposes without the payment of any royalty thereon.

BACKGROUND OF THE INVENTION

In the past the failure point of electronically scanned arrays has been computed by ratioing the number of failed modules in the array to the total number of modules. This method provided a straight percentage which was selected to account for the occurrence of coordinated module failures, as well as randomly occurring module failures, and this percentage did not weight the location of the failures. In accordance with this invention, we provide weighting factors for the failed modules by accounting for the size and the location of the detected failures.

The prior art includes the following:

| U.S. Pat. No. | Inventor(s) |
|---|---|
| 4,926,186 | Kelly et al |
| 4,176,354 | Hsiao et al |

Kelly et al and Hsiao et al are each concerned with monitoring the operability or performance of phased array antenna systems. The Kelly et al method involves sampling the radiated beam by means including a single receiver and at non-uniform intervals of time during a beam scan, analyzing the samples to provide amplitude and phase values, and comparing same with design values to reveal elements or phase shifters which may be faulty.

Hsiao et al disclose a method which involves feeding a portion of radiated signals to a manifold network which combines them with signals symmetrically located with respect to the center of the array so that they differ by 180 degrees at the single manifold output. The output is then adjusted to zero by addition of radio frequency energy and the phase-shift settings of pairs of radiating elements having equal amplitude-weighting varied from the initial settings through 360 degrees. Failures are located by correlating the phase-shift settings and the adjusted output of the manifold network.

None of the prior art patents are concerned with the inventive features of defining failures, by assessing a severity weight to each module location in the array, totalling the score for all failures, and comparing the total to a threshold to determine if maintenance is warranted.

SUMMARY OF THE INVENTION

This invention is for a method of determining when maintenance is required for a phased antenna array in which a number of individual antenna modules may have failed. The method provides for the assigning of a value to each failed module, depending on where the module is located within the array, and also depending on whether the module is "coordinated" with one or more other failed modules. A threshold value for the aggregate of all the values of the failed modules is established and upon exceeding the threshold, maintenance of the array is indicated.

OBJECTS OF THE INVENTION

It is an object of this invention to prioritize the severity of a failure of a phased antenna array module by determining the size of the failure, and accounting for the position of the failed module in the overall array.

Another object of this invention is to provide a method for defining failure of an antenna array by determining the location of each failed module, assessing a severity weight to each module location in the array, totalling the score for all failures, and comparing the total to a predetermined threshold to establish whether or not maintenance of the array is required.

Still another object of this invention is to provide a method of scoring which allows the maintenance time of antenna arrays to be more closely tied into performance characteristics rather the on a purely statistical basis.

BRIEF DESCRIPTION OF THE DRAWINGS

These and other objects and features of the invention will become more apparent after considering the following description taken in conjunction with the illustrative embodiment in the accompanying drawings in which.

DESCRIPTION OF A PREFERRED EMBODIMENT

Figure 1:
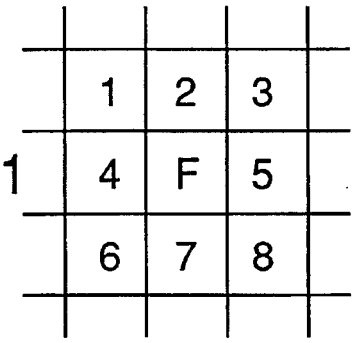
FIG. 1 is a diagram showing an example of a coordinated failure.
Figure 2:
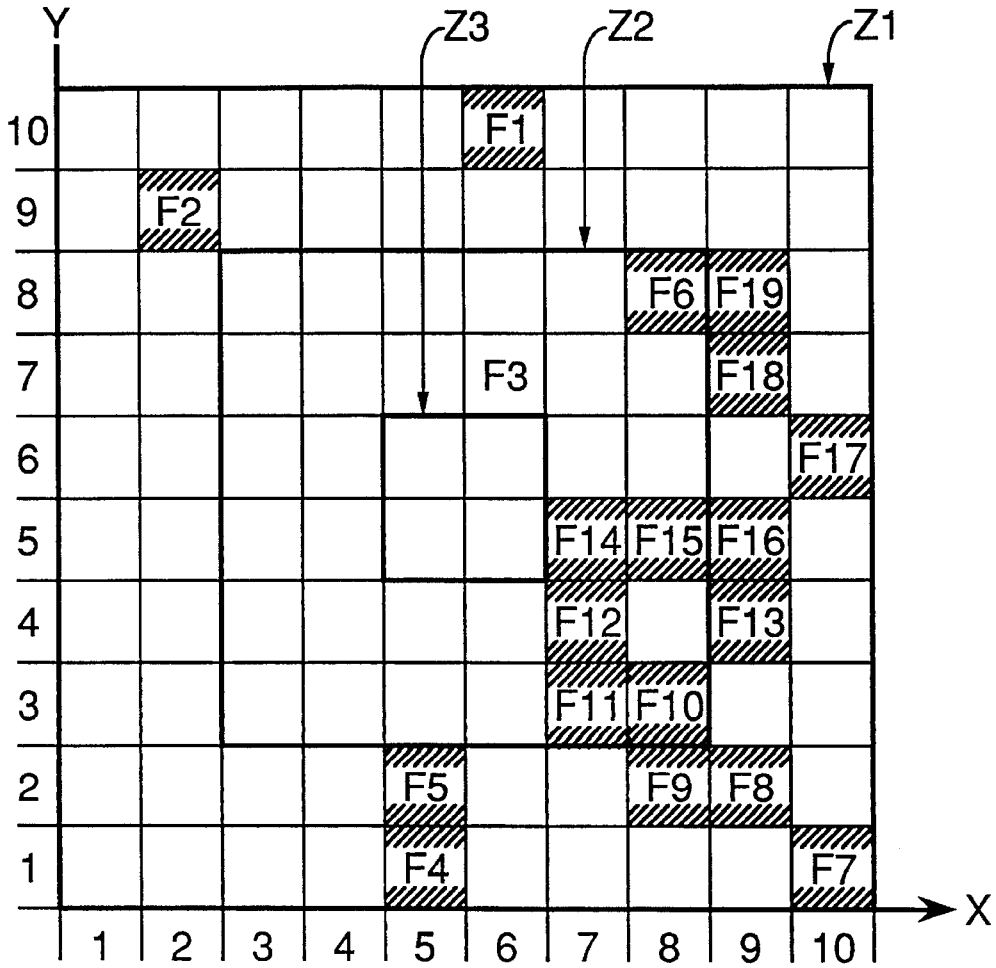
FIG. 2 is a diagram showing the results of a search for faults in a 10×10 antenna array.

The method is illustrated in FIGS. 1 and 2, to which reference should now be made. In FIG. 1 are shown 9 antenna modules numbered 1–8 and F. These 9 modules are part of a phased antenna array which may contain a hundred or more phased antennas. Of the 9 modules shown in FIG. 1, module F has been determined by conventional monitoring to be a failed module. The modules 1–8, located around the failed module F are considered "connected" to the failed module F. A coordinated failure is defined as two or more connected module failures. Any module in locations 1–8 adjacent the failed module F is considered connected to the module F, and a coordinate failure (or blob) is defined as two or more connected failures. Thus, if any one, or more of the connected modules 1–8 were determined to have failed, module F, and the other failed modules are defined as coordinated failures.

The procedure for determining the failure point of an electronically scanned array requires the mapping and storing of the arrays in the memory of a CPU of a computer. The modules are then monitored by scanning, using conventional techniques, to determine whether or not any modules have failed, and to note such failures on the map stored in the CPU. The stored information is then analyzed to determine if it:

1) is an isolated randomly occurring module failure.

2) is an element of a recently occurring coordinated failure.

3) is a new element of an already existing coordinated failure.

4) connects two or more coordinated failures that already exist.

This is accomplished in the CPU memory by maintaining two binary maps of module failures. One map is a failure history of the array, and the second is the results of the last test sequence of the array.

By way of example, FIG. 2 is a "map" on X,Y coordinates of an antenna array, as stored in the system's CPU. The illustrated map shows a 10×10 array of modules laid out on X,Y coordinates, the letter F representing a failed module. As seen in the example of FIG. 2 there are three single module failures F1, F2 and F3; there is one 2 module coordinated failure represented by F4 and F5; and there is one 14 module coordinated failure represented by F7 to F19.

In the example shown in FIG. 2, there are 19 failed modules out of 100, representing 19% of the array. If each module failure was rated with equal values, for example, 1 point per failure, the illustrated example would score 19 points.

In accordance with this invention, the antenna designer establishes a threshold level, a predetermined number of points, at which time maintenance for the system is required. A given number of points is then assigned to each failed module depending on its location within the map of the array. For example, in FIG. 2, three zones Z1, Z2 and Z3 are illustrated. Failure modules in zone Z1 are assessed a score of 1 point. Failed modules in zone Z2 are assessed a score of 2 points. Failed modules in zone Z3, the central area of the array, are assessed a score of 3 points. In the illustrated example, there are 12 failures in zone Z1, 7 failures in zone Z2, and no failures in zone Z3. The score for this example would be 12×1 plus 7×2, for a score of 26 out of a possible 140 points, or 11.4 percent, since none of the failures were zone Z3, and most were in zone 1. On the other hand, if the same 19 failures had occurred primarily in the central zones of the arrays, the same number would produce a substantially higher score. For example if the situation were such that 2 failures occurred in zone Z3, and 10 in zone Z2 and 5 in zone Z1, then those 19 failures would produce a score of 6+20+5=31. In the first case a given threshold might not have been reached, while in the latter example, the threshold might have been exceeded.

In practice, the phased antenna array is scanned by any one of the conventional methods shown in the prior art to determine which of the antenna modules are faulty. For example refer to the patents to Hsiao et al, U.S. Pat. No. 4,176,354 or Kelly et al, U.S. Pat. No. 4,926,186 noted above. A map of the acquired data is then stored in the CPU of the computer, and each zone of the map is assigned a point value. A threshold score is established by the design engineer, and when the total number of points produces a score which exceeds the threshold, maintenance of the system is indicated.

As a further refinement to the method of this invention, the designer may assess an added value to any failures which are coordinated, for example, each failed module, which is part of a "blob" may be upgraded in its point assessment by a given percentage.

The method has application in both active and passive aperture phased arrays. Prioritization of failure severity is accomplished by determining the size of the "blob" and accounting for its position in the array, reflecting increased severity of failure occurring nearer the array center (i.e., a smaller coordinated failure of elements may have greater impact on antenna pattern than larger coordinated failures near the array periphery. This assessment is accomplished by assigning a weighting factor to each element based on its location in the array. Execution time is minimized by performing search only on newly occurred failures (failures which were detected in the last test sequence) to determine if they are part of a newly detected coordinated failure, or if they are attach to a coordinated failure that already existed prior to the last test sequence, but did not meet the severity criteria to declare a failure of the array.

Clearly, many modifications and variations of the present invention are possible in light of the above teachings and it is therefore understood, that within the inventive scope of the inventive concept, the invention may be practiced otherwise than specifically claimed.

What is claimed is:

1. In a phased antenna array having a plurality of antenna modules arranged in a set of vertical and horizontal coordinates, a method for determining the aggregate severity of the failure of a plurality of said modules, said method comprising:

establishing a threshold criteria for representing the summation of the aggregate failures beyond which maintenance of said antenna array is required;

storing said threshold criteria in a computer;

scanning each module in said array to determine which, if any, of said modules have failed, and storing the identities and locations of the failed modules in vertical and horizontal coordinate locations in said computer;

applying a weighting factor to each failed module to establish a severity score for each module, said weighting factor being a function of the location of each such module in said array;

summing all of said scores to establish the aggregate severity stored in said computer of all module failures; and comparing said stored summed score with said stored threshold criteria.

2. The method of claim 1, wherein said array has a plurality of quadrilateral concentric zones, each with a different weighting factor, with the modules at the center of said array assigned a higher weighting factor than the modules at the periphery of said array.

3. The method of claim 2, wherein a failed module which is connected to another failed module in an adjoining zone is provided with a different weighting factor than one which is not so connected.

4. The method of claim 2, wherein a central quadrilateral zone is surrounded by an intermediate guadrilateral zone which is, in turn, surrounded by an outer quadrilateral zone.

5. The method of claim 2, wherein a failed module which is connected to another failed module in the same zone is provided with a different weighting factor than one which is not so connected.

6. A method for establishing failure severity in phased antenna arrays containing a plurality of antenna modules, comprising the steps of:

establishing a failure threshold beyond which said array is considered to be in failure;

scanning each module in said array to determine which modules in said array have failed;

assigning to each failed module a weighting factor dependent solely on its location in said antenna array; wherein a failed module which is connected to another failed module is provided with a high weighting factor than one which is not so connected;

summing the total of the weighting factors for failed modules; and comparing the summation of said weighting factors with said failure threshold; thereby to determine if said array is considered to be in failure.

* * * * *